United States Patent [19]

Griganavicius

[11] Patent Number: 4,471,822

[45] Date of Patent: Sep. 18, 1984

[54] MACHINE FOR MANUFACTURING DRAWER SIDES

[75] Inventor: Zigmas Griganavicius, Downey, Calif.

[73] Assignee: Goldenhill Wood Products, Inc., Los Angeles, Calif.

[21] Appl. No.: 463,997

[22] Filed: Feb. 4, 1983

[51] Int. Cl.[3] ..... B27C 9/04

[52] U.S. Cl. ..... 144/3 R; 51/5 C; 51/139; 144/136 R; 144/360; 144/368

[58] Field of Search ..... 144/1 R, 2 R, 3 R, 360, 144/367, 368, 369, 371, 136 R; 51/5 C, 139

[56] References Cited

U.S. PATENT DOCUMENTS 2,593,745 4/1952 Gillespie ..... 144/3 R 4,260,001 4/1981 De Muynck ..... 144/3 R

*Primary Examiner*—W. D. Bray

*Attorney, Agent, or Firm*—Harris, Kern, Wallen & Tinsley

[57] ABSTRACT

A machine for manufacturing drawer sides in a continuous operation from a strip of wood. A machine with opposed edge cutters for shaping the outer edges of the strip, a slitting unit for cutting the strip into two strips and for cutting grooves in each strip, and opposed sanding units for smoothing the outer edges. A pair of slitting units with different saw blade settings for producing different drawer sides, and a mechanism for introducing one slitting unit or the other into the overall machine for rapid change of product configuration.

6 Claims, 8 Drawing Figures

4
5
16
21
22
23
24
25
26
27
31
35'
40'
41'
42'
43
44
45
62
63
64
65
80
81
82
83
84
85

MACHINE FOR MANUFACTURING DRAWER SIDES

BACKGROUND OF THE INVENTION

The present invention relates to a new and improved machine for manufacture of drawer sides in a continuous operation, from a strip of wood or the like. At the present time, a considerable amount of wooden furniture is produced from composite material such as particle board and chipboard, as well as from solid wood, and the term "wood" as used herein is intended to cover all of these wood-like materials.

A drawer for a desk or chest or other piece of furniture typically is formed of two sides, a front, a back, and a bottom. A typical drawer side 10 is shown in FIG. 2, and comprises a short piece of wood with a rounded and smooth edge 11, and a longitudinal groove 12 parallel to the lower edge. The front and rear edges 13, 14 may dovetailed or otherwise modified for attaching the front and rear of the drawer, and the groove 12 provides a recess for supporting the drawer bottom.

In the conventional drawer side manufacturing machine, a long strip of wood is fed in at one end, the outer edges are rounded, the strip is cut into two strips and drawer grooves are cut into the two strips, and the outside edges are sanded. Typically the two long strips are further treated by painting or other surface finishing of the surfaces and finally are cut to the desired lengths.

A cross-section of an incoming strip 16 is shown in FIG. 1*a*, a cross-section of the strip with the rounded edges 11, 11' is shown in FIG. 1*b*, and cross-sections of the two strips 10, 10' is shown in FIG. 1*c*, with the initial strip sawn into two pieces at 17 and with the grooves 12, 12' provided in the side strips 10, 10' respectively.

The conventional machines have a high production rate, and an order for drawer sides can be produced in a relatively short time. The next order for drawer sides usually requires a different position for the cut which separates the initial strip into two strips, and different settings for the spacing and depth of the saw blades which produce the bottom grooves 12, 12'. This change requires shutting down the machine, removing the existing saw blades and installing a new set of blades with new spacings. While this operation is straight forward, it is time consuming and the entire machine is out of production during the blade changing and adjusting operation.

It is an object of the present invention to provide a new and improved machine for producing drawer sides which permits a very rapid change in saw blades so that the machine downtime required for change of set up is reduced to a minimum. It is a particular object of the invention to provide such a machine incorporating two slitting units, each capable of mounting a plurality of saw blades of various sizes and with various spacings, with the slitting units being interchangeable in the production stream of the machine. An additional object is to provide such a drawer side manufacturing machine with a transverse carriage formed as a portion of the frame, with the two slitting units mounted on this carriage and with each slitting unit slidableinto and out of the production line on the machine.

With this arrangement, a set of blades for an order can be installed and adjusted on a slitting unit while the preceding order is being run on the machine. Then the downtime between orders for different drawer side configurations is only the time needed for sliding one slitting unit out of the operative position and sliding the other slitting unit into the operative position.

Other objects, advantages, features and results will more fully appear in the course of the following description.

SUMMARY OF THE INVENTION

A drawer side manufacturing machine having a frame with a longitudinal axis and a transverse axis, means for moving a strip of wood along the longitudinal axis past various operating stations, and first and second slitting units mounted on the frame for back and forth movement along the transverse axis, with the first and second units being alternately positionable at the longitudinal axis in a working location.

In the preferred embodiment each of the slitting units includes an arbor disposed parallel with the transverse axis, a drive motor for the arbor, and means for mounting a plurality of saw blades of various sizes on the arbor in control spaced relation, with the saw blade spacing being adjustable, and with the saw blade sizes and/or spacings capable of being set differently on the first and second units.

Each slitting unit preferably includes a base carried on the frame, a motor support plate with the motor and arbor carried thereon, and interengaging means for slidably mounting the motor support plate on the base and providing for vertical adjustment of the position of the arbor relative to the frame. Further, each slitting unit preferably includes a vertical guide carried on the motor support plate and resting on a slide plate, with a lead screw engaging the vertical guide and support plate for translating the vertical guide and arbor parallel to the transverse axis relative to the slide plate.

Also, the machine preferably includes first and second edge cutters carried on the frame and adjustable in position for shaping opposing edges of wood strips of various sizes, and first and second edge sanding units carried on the frame and positionable for smoothing the opposed cut edges.

DESCRIPTION OF THE PREFERRED EMBODIMENT

Figures 3, 3A:
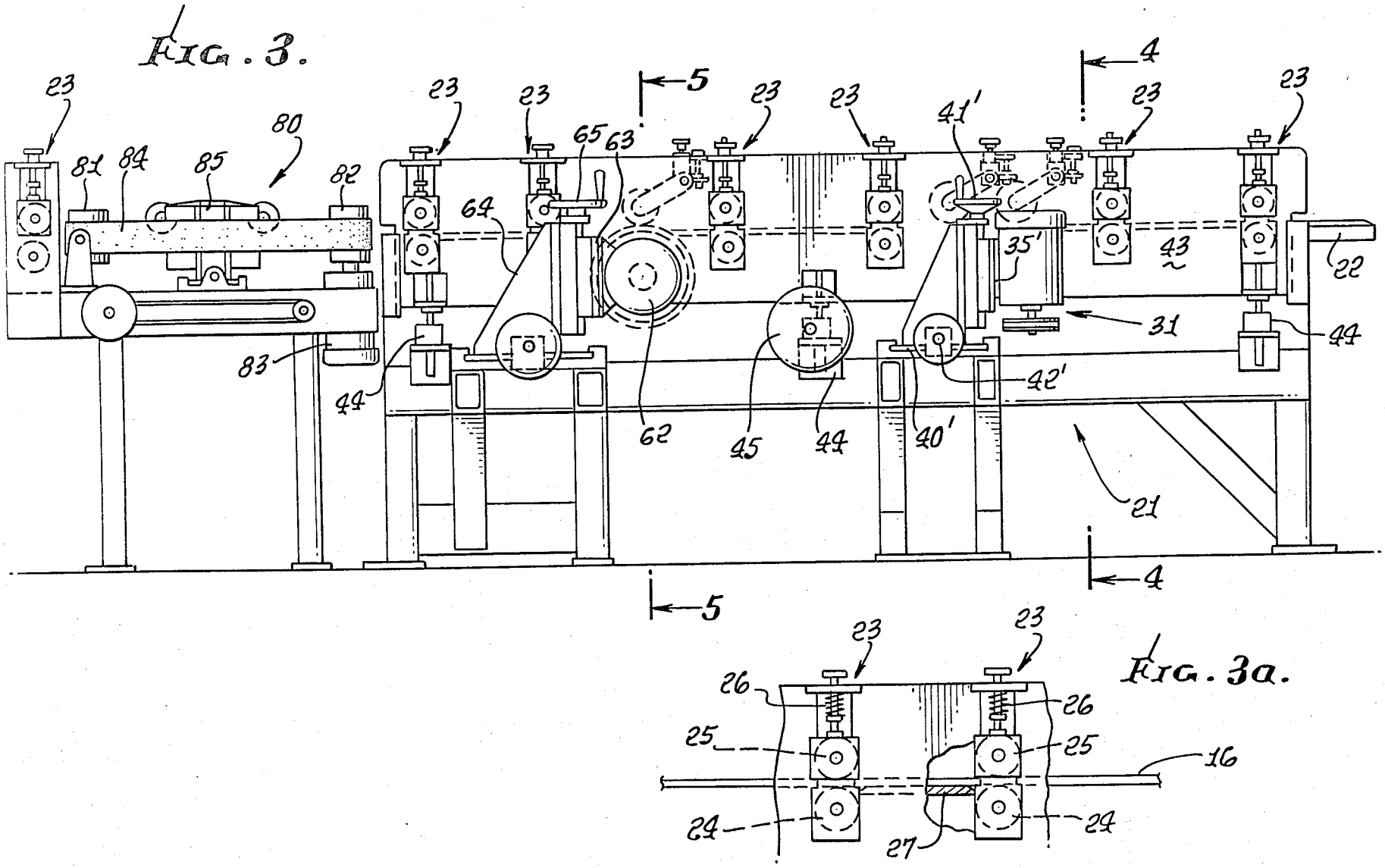
FIG. 3 is a side view of a machine incorporating the presently preferred embodiment of the invention.
FIG. 3*a* is an enlarged view of a portion of the machine of FIG. 3 illustrating the movement of the strip through the machine.

The drawer side manufacturing machine of FIG. 3 has a frame indicated generally at 21, with a shelf 22 at the inlet end for supporting a strip of wood which is moved through the machine from right to left along a longitudinal axis by sets of rolls 23. Two sets of the rolls are shown in greater detail in FIG. 3*a*, with each set having a lower roll 24 rotating on a fixed axis, and an upper roll 25 rotating on a axis which may move vertically. The upper roll 25 is urged downward by a spring mechanism 26 for gripping the strip 16 between the upper and lower roll. The lower roll may be powered in the conventional manner to drive the strip through the machine. A support plate 27 is carried on the frame between the two sets of rolls shown in FIG. 3*a*, and similar support plates may be positioned along the longitudinal axis as desired.

Figure 1:
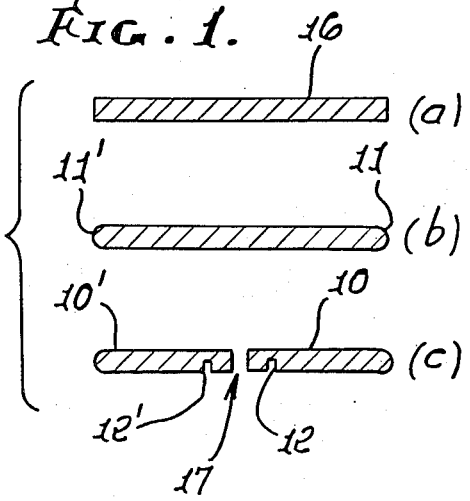
FIGS. 1*a*, *b* and *c* are sectional views of a strip of wood illustrating the production of a drawer side.
Figure 2:
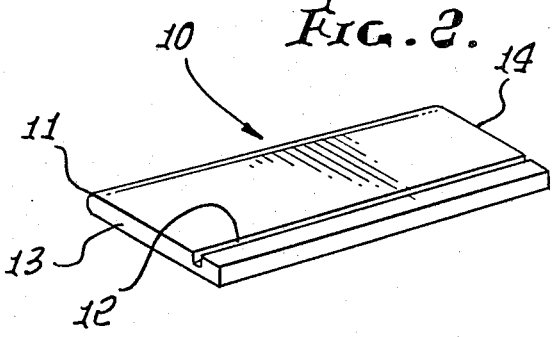
FIG. 2 is a perspective view of a drawer side as produced on the machine of the invention.
Figure 4A:
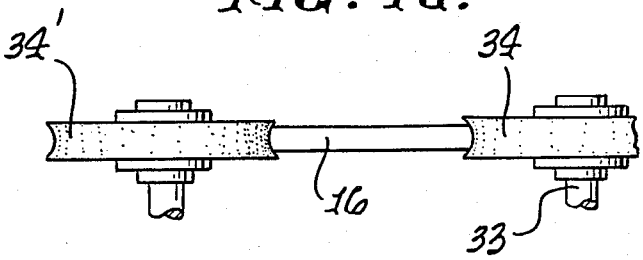
FIG. 4*a* an enlarged view of a portion of FIG. 4 illustrating the edge cutting operating.
Figure 4:
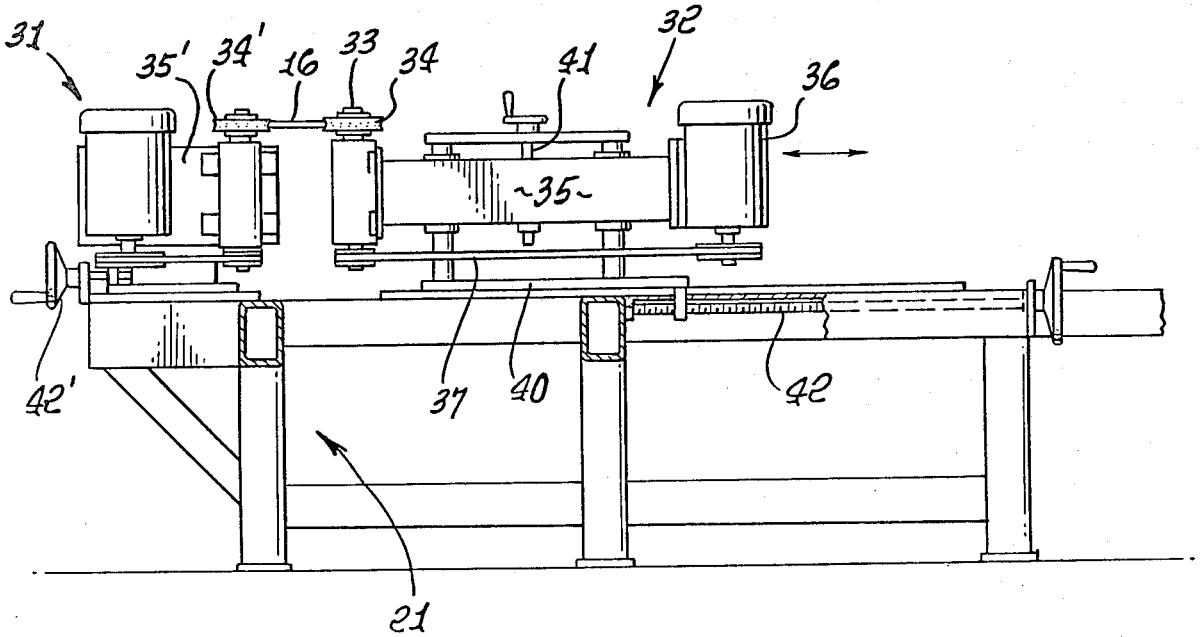
FIG. 4 is a sectional view taken along the line 4—4 of FIG. 3.

Edge cutters 31, 32 are carried on the frame 21, as best seen in FIG. 4. The edge cutters may be directly opposite each other, or one may be downstream from the other, the latter configuration being preferred. The edge cutter 32 includes a shaft 33 for carrying a cutter 34, with the shaft journalled in a cutter plate 35. A drive motor 36 is also carried on the cutter plate and drives the shaft 33 by a belt 37. The edge cutter 31 has a similar construction with cutter shaft and drive motor carried on a cutter plate 35'.

The cutter plate 35 is carried on another cutter plate 40, with a screw mechanism 41 for moving the plate 35 vertically relative to the plate 40. The plate 40 slides horizontally on the frame and is positioned by another screw 42. The cutter plate 35' is similarly carried on another plate 40' and is vertically adjusted by a screw mechanism 41' and laterally adjusted by a screw mechanism 42'.

With these adjustments, the cutters 34, 34' may be adjusted vertically to properly engage the edges of the strip 16 for various thicknesses of strip, and may be adjusted laterally for variouswidths of the strip 16. Side plates 43 are supported on conventional jacks 44, which may be manually actuated by a hand wheel 45, for vertical adjustment.

Figure 5:
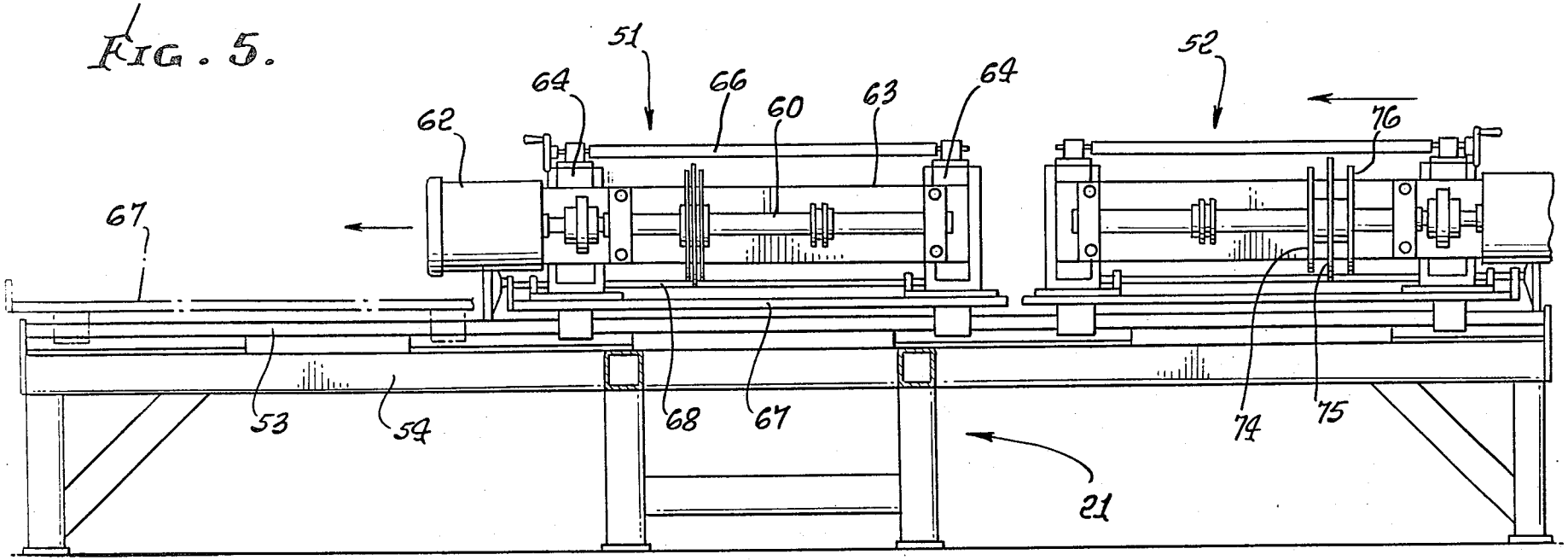
FIG. 5 is a sectional view taken along the line 5—5 of FIG. 3.

Two slitting units 51, 52 are slidingly mounted on guide rails 53 of a transverse section 54 of the frame 21 (FIG. 5). The slitting units 51, 52 may be identical in construction and operation, with one being a mirror image of the other, and the unit 51 will be described in greater detail herein.

An arbor 60 is journalled in blocks 61 and driven by a motor 62, with the blocks and motor carried on motor support plate 63. The motor support plate 63 is carried in vertical guide members 64 and is moved vertically by a screw mechanism 65, with the vertical guide members interconnected by a rod 66. The vertical guide members rest on a slide plate 67 which in turn slides on the guide rails 53. A lead screw 68 engages the vertical guide members and the slide plate for transversely positioning the arbor relatively to the slide plate.

Figure 5A:
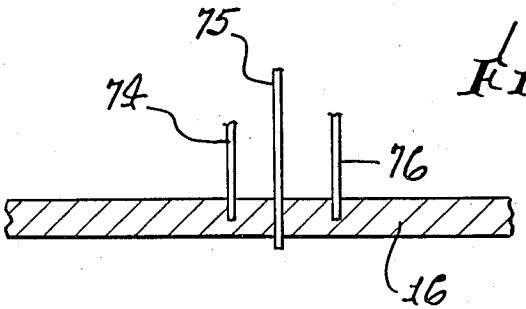
FIG. 5*a* is an enlarged view of a portion of FIG. 5 illustrating the sawing operation.

A plurality of circular saw blades is mounted on the arbor 60 utilizing conventional collars, keys and spacers. Usually, three blades 74, 75,76 are used for cutting the strip into two sections and for cutting two bottom grooves, as shown in FIG. 5*a*.

In use, the saw blades for the slitting unit 51 are selected for the particular order being run, and are mounted on the arbor with the appropriate spacing. The slitting unit 52 is moved to the right out of the path of the strip moving along the longitudinal axis of the machine, and the slitting unit 51 is moved into place, as shown in FIG. 5. The saw blades are adjusted vertically and transversely by means of the screw mechanisms 65 and 68, and the machine is ready for running the order. While this order is being produced, saw blades for the next order are set on the arbor of the slitting unit 52.

Then as soon as the first order is completed, the slitting unit 51 is slid to the left and the slitting unit 52 is also slid to the left replacing the slitting unit 51 in the production line. The minor adjustments are made for precisely positioning the units and the machine is ready for running the next order, with a very short downtime.

A pair of edge sanding units are positioned downstream of the slitting units, for smoothing the edges 11, 11' produced by the cutting units 31, 32. The near side sanding unit 80 is seen in FIG. 3 and includes spindles 81, 82 rotating about vertical axes, with the spindle 82 driven by a motor 83. A sanding belt 84 is mounted on the spindles and a belt backing unit 85 is positioned within the loop of the belt 84. The purpose of the backing unit 85 is to provide a resilient force urging the belt against the wood strip as it moves through the machine. The construction and operation of the sanding units may be conventional.

I claim:

1. In a drawer side manufacturing machine, the combination of:

a frame having a longitudinal axis and a transverse axis, with said longitudinal axis defining a production line;

means for moving a strip of wood along said longitudinal axis; and first and second slitting units mounted on said frame, each of said slitting units including means for moving the unit back and forth along said transverse axis, with said first and second units being alternately positionable in line with said production line, each of said slitting units including an arbor disposed parallel with said transverse axis, a drive motor for said arbor, and means for mounting a plurality of saw blades of various sizes on said arbor and including means for adjusting the spacing between said saw blades, and with saw blade sizes and/or spacings capable of being different on said first and second units.

2. A machine as defined in claim 1 wherein each of said slitting units includes:

a base carried on said frame;

a motor support plate with said motor and arbor carried thereon; and interengaging means for slidably mounting said motor support plate on said base, including means for vertically adjusting the position of said arbor relative to said frame.

3. A machine as defined in claim 2 wherein said base of each of said slitting units includes vertical guide means carrying said motor support plate and resting on a slide plate, and lead screw means engaging said vertical guide means and plate for translating said vertical guide means and arbor parallel to said transverse axis relative to said slide plate.

4. A machine as defined in claim 3 wherein said frame includes transversely disposed guide rails for slidably supporting said bases of said slitting units.

5. A machine as defined in claim 4 including first and second edge cutters carried on said frame, each of said edge cutters including:

a first cutter plate;

a vertically disposed drive shaft for carrying a cutting wheel and journalled on said first cutter plate;

a motor for driving said drive shaft;

a second cutter plate;

means for mounting said first cutter plate on said second cutter plate for relative vertical movement; and means for mounting said second cutter plate on said frame for transverse movement.

6. A machine as defined in claim 5 including first and second edge sanding units carried on said frame, each of said edge sanding units including:

first and second vertically positioned spindles spaced from each other parallel to said longitudinal axis for carrying a belt over said spindles;

a drive motor for one of said spindles; and a belt backing unit positioned between said spindles for urging a belt outward into engagement with a strip moving between said edge sanding units.

* * * * *